United States Patent [19]

Bartenbach

[11] Patent Number: 4,539,628

[45] Date of Patent: Sep. 3, 1985

[54] NONGLARE LIGHT FIXTURES FOR A ROD-SHAPED LIGHT SOURCE

[76] Inventor: Christian Bartenbach, Lindenschmittstrasse 23, 8000 Munchen 70, Fed. Rep. of Germany

[21] Appl. No.: 595,592

[22] Filed: Apr. 2, 1984

[30] Foreign Application Priority Data

Apr. 8, 1983 [AT] Austria ..... 1246/83
Dec. 20, 1983 [EP] European Pat. Off. ..... 83112800.4

[51] Int. Cl.[3] ..... F21V 11/06

[52] U.S. Cl. ..... 362/217; 362/260; 362/291; 362/297; 362/342; 362/347

[58] Field of Search ..... 362/290–292, 362/217, 279, 297, 342, 346, 347, 350, 260

[56] References Cited

U.S. PATENT DOCUMENTS

| | | | |
|---|---|---|---|
| 1,153,443 | 9/1915 | Pole | 362/347 |
| 2,299,276 | 10/1942 | Kirlin | 362/342 |
| 3,124,310 | 3/1964 | Lipscomb | 362/342 |
| 3,363,093 | 1/1968 | Schmitt | 362/347 |
| 3,382,357 | 5/1968 | Welty | 362/347 |
| 3,560,729 | 2/1971 | Liberman | 362/347 X |
| 4,407,011 | 9/1983 | Lahm | 362/290 X |

FOREIGN PATENT DOCUMENTS 8106507 3/1981 Fed. Rep. of Germany .

*Primary Examiner*—Peter A. Nelson
*Attorney, Agent, or Firm*—Jones & Askew

[57] ABSTRACT

Light fixtures with a rod-shaped light source (1) and with concave reflectors on both longitudinal sides of the light source. The concave reflectors extend above the light source, and have a curvature such that all light rays reflected across the light source will emerge in the transverse direction either directly or after reflection at an angle that is steeper than a light-specific masking angle ($\alpha$). The reflectors include lamellae (4) that have an approximately V-shaped cross section and run across the middle vertical longitudinal plane of the light source and have reflecting concave side surfaces with a curvature such that all light rays reflected in the longitudinal direction of the light source (1) will emerge in the longitudinal direction either directly or after reflection at an angle that is steeper than a light-specific masking angle ($\beta$). The top sides (8) of the lamellae are covered by a flat reflecting cover, and the lamellae are shaped so as to form two lamellar sections that are symmetrical with the middle vertical longitudinal plane; their flat top sides, starting below the light source, form an angle with the longitudinal plane that approximately corresponds to the masking angle ($\alpha$) and have the opposite slopes such that they are in tangential proximity to the light source (1) but do not come in contact with it, and they extend as far as the reflectors (2).

3 Claims, 3 Drawing Figures

NONGLARE LIGHT FIXTURES FOR A ROD-SHAPED LIGHT SOURCE

FIELD OF THE INVENTION

This invention relates in general to light fixtures, and relates in particular to light fixtures having lamellae which reflect incident beams of light free from glare.

BACKGROUND OF THE INVENTION

The present invention concerns a light fixture with a rod-shaped light source, and on both longitudinal sides of the light source, extending over it, there are concave reflectors that have a curvature such that all the light rays reflected across the light source emerge in the transverse direction either directly or after reflection at an angle that is steeper than a light-specific masking angle $\alpha$, and with lamellae that have an approximately V-shaped cross section and run across the middle vertical longitudinal plane of the light source and have reflecting concave side surfaces that have a curvature such that all the light rays eflected in the longitudinal direction of the light source will emerge in the longitudinal direction either directly or after reflection at an angle which is steeper than a light-specific masking angle $\beta$, and the top sides of the lamellae are covered by a reflective cover.

In light fixtures of the above-mentioned type, the surface of the lamellae running across the light source is designed to be reflective, so that even light rays striking the lamellae from above can be reflected and can finally emerge out of the light. Otherwise, the efficiency of such light fixtures would be reduced substantially because the lamellae must be spaced at relatively short distances from each other if the desired goal of masking light rays emerging at a shallow angle is to be achieved. An important drawback of the known design, however, is that the light rays reflected from the top sides of the lamellae emerge for the most part at a shallower angle than the incident angle, and this leads to a mirror image of the light source for the observer, and this ultimately leads to a glare effect. This mirror image is especially disturbing in working with display screens. To prevent this problem, proposals have already been made for blackening the top side of the lamellae or designing them so as to be open at the top. Both cases, however, lead to the above-mentioned loss of efficiency, which may amount to as much as 20%.

In addition, a light fixture with an elongated lamp is known from German Utility Patent No. 81 06 507, in which case to avoid extreme brightness in the vicinity of the reflector sections above the lamellae, the covers to the lamellae have sloping sections in the space above the lamp that are inclined toward the vertical plane of the lamp. These sloping sections may have a concave curvature, for example. Owing to this design, some of the rays reflected by the light source may be reflected into the space above the light source by the inclined covers, but precisely in the critical areas where the lamellae meet the reflectors, there is still a problem with reflections leading to the undesired brightness.

This invention is based on the the goal of improving a light fixture of the type described initially, so that the entire cover area of the lamellae will reflect incident beams of light in such a way that complete freedom from glare is achieved.

According to this invention, this is achieved by shaping the lamellae so as to form two lamellar sections that are symmetrical with respect to the middle longitudinal plane so that their flat surfaces form an angle of inclination with the longitudinal plane that corresponds approximately to the masking angle $\alpha$, and they have the opposite slopes and are in tangential proximity to the light source, although without coming in contact with it, and extend as far as the reflectors. According to this invention, the cover of the lamellae is not curved, but instead the cover of the lamellae is flat and the lamellae themselves are inclined with respect to the longitudinal plane of the light source, namely from below the light source up to above the light source. This design of the lamellae according to this invention assures that reflections in the interfering angle of view range which is defined by the masking angle $\alpha$ are avoided with these reflectors because the lamellae run in this range. Below the masking angle $\alpha$ complete freedom from glare is achieved according to this invention without any mentionable loss of efficiency due to absorption of the light rays striking the top side of the lamellae. The best solution theoretically is a flat top side which would be in tangential contact with the light source. However, for structural and tolerance reasons, such contact of a light source with the lamellae is impossible. For this reason, the present invention proposes a tangential approach of the top side of the lamellae to the light source, but maintaining a distance which is determined by the design.

This invention will now be illustrated in greater detail with reference to the figures.

BEIEF DESCRIPTION OF THE DRAWINGS

DESCRIPTION OF THE PREFERRED EMBODIMENTS

Figure 1:
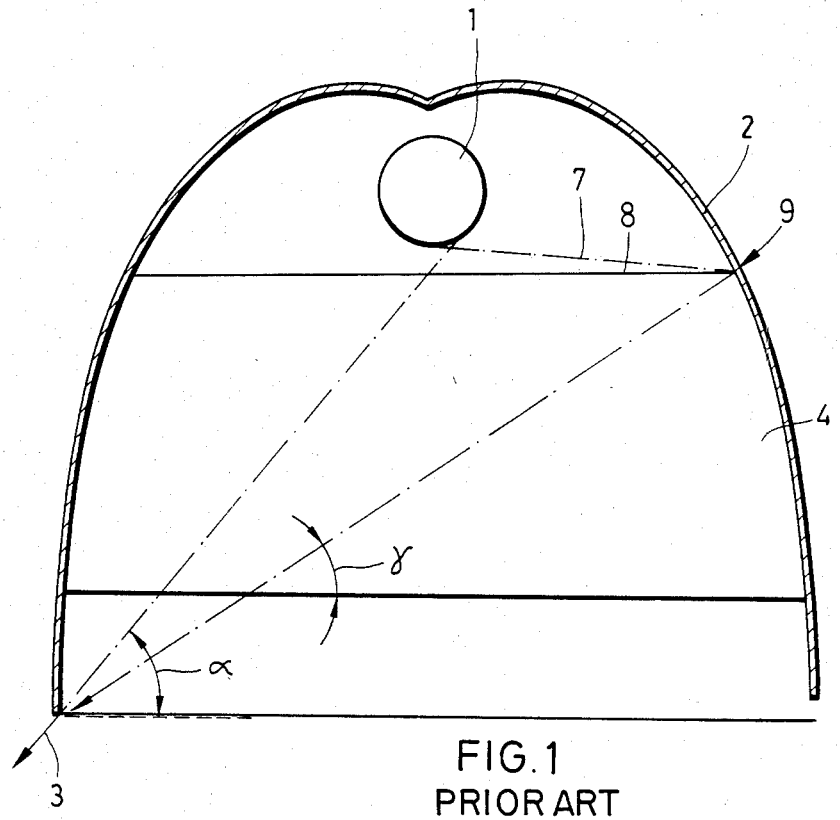
FIG. 1 PRIOR ART
FIG. 1 shows in schematic form a cross section through a known light fixture according to the state of the art.

Light fixtures of the known type (see FIG. 1) have a rod-shaped light source (fluorescent or neon lights) 1 with a reflectors 2 around it. The contour is such that any beam of light reflected by it will leave the light fixture at a steeper angle than a beam 3 which comes in contact with the lower edge of the light source and the lower edge of the reflector 2. The angle $\alpha$ is thus the masking angle in the transverse direction.

In order to prevent glare that is also due to rays of light emerging at a shallow angle in the longitudinal direction of the light (see FIG. 2), lamellae 4 are provided across the longitudinal axis of the light source 1 which have a height and spacing that is selected so that all beams of light will be reflected by the concave side surfaces 5 and will leave the light source at a shallower angle than the beam 6 which forms a tangent with the upper or lower edge of the opposite side surfaces 5 of two neighboring lamellae 4. This beam 6 forms an angle $\beta$ with the horizontal. The angle $\beta$ is the masking angle in the longitudinal direction and, as a rule, is of the same order of magnitude as the angle $\alpha$ in the transverse direction.

Figure 2:
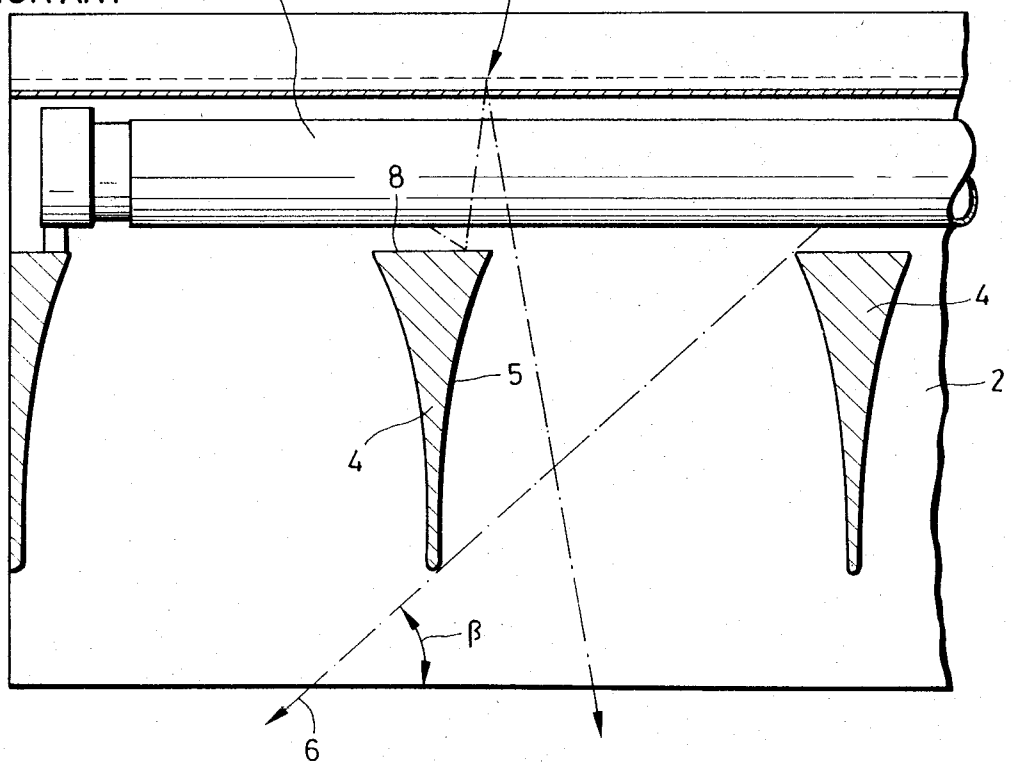
FIG. 2 PRIOR ART
FIG. 2 shows a longitudinal section through the light fixture according to FIG. 1.

As FIG. 1 shows, there are beams which leave the light at an angle which is smaller than the angle $\alpha$ when the top side 8 of the lamellae 4 is designed to be reflective to prevent light loss. This is illustrated on the basis of the beam 7. The slope of the reflector wall at the point 9 is such that a beam of light emerging from the lower edge of the light source 1 is reflected there at an angle $\alpha$ with the horizontal. However, the beam 7 which has just been reflected upward at the top side 8 of the lamellae 4 is deflected downward at the point 9 to a lesser degree and leaves the light fixture at an angle $\Xi$ which is smaller than the masking angle $\alpha$. As indicated in FIG. 2, this phenomenon affects only beams of light leaving the light source 1 obliquely. On the whole, however, this yields a mirror image of the light source 1 for an observer looking up at the light at a relatively shallow angle, and this yields glare.

Figure 3:
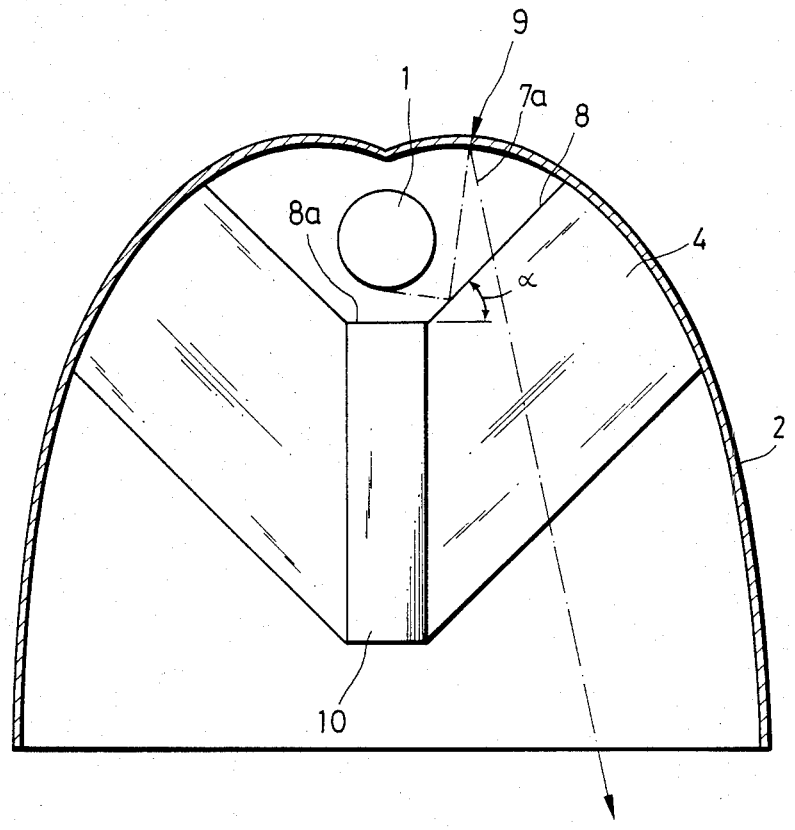
FIG. 3 shows a cross section through a light fixture according to this invention.

In FIG. 3, a light according to this invention is shown where the glare described above is avoided. To do so, the lamellae 4 are shaped on the top side 8 so as to form two lamellar sections which are positioned symmetrically with respect to the middle vertical longitudinal plane of the light source 1, and the top sides 8 form an angle of inclination with the longitudinal plane, starting from below the light source 1, and the horizontal, such that the angle corresponds approximately to the masking angle $\alpha$ with the opposite slopes. This yields a tangential contact-free proximity of the flat top sides 8 to the light source 1. The two lamellar sections end in the side reflectors 2. Howeer, a certain spacing between the flat surfaces 8 and the light source is maintained for reasons of tolerance and manufacturing conditions, so that the desired tangential shape according to this invention with tangential contact is not achieved. However, this does not yield any measurable disadvantage in using the lights according to this invention. Furthermore, according to this invention, the two inclined lamellar sections are connected by a vertical lamellar section 10 that forms a right angle with the middle longitudinal plane of the light source 1, resulting in a horizontal pattern of lamellae below the light source 1. The ideal case here would be for the shape of the lamellae to correspond to the surface of the light source. For production reasons, however, a horizontal lamellar section is preferable. In addition, it is also advantageous for the lower longitudinal edge of the lamellae 4 to be parallel with the top surface 8 of the lamellae.

In this way, the width of the lamellae according to the invention does not differ from that of the known version illustrated in FIGS. 1 and 2, thus avoiding the light losses which would occur with a broader lamella shape.

As shown on the example of a beam of light *7a* in FIG. 3 which leaves the light source 1 at the same point and at the same angle as the beam 7 in FIG. 1, and leaves the light fixture according to this invention at a very steep angle after reflection at the reflector 2, resulting in nonglare reflection from the light source 1.

I claim:

1. In a light fixture with a rod-shaped light source and concave reflectors on both longitudinal sides of the light source extending above the light source, the concave reflectors having a curvature such that all the rays of light reflected across the light source emerge in the transverse direction either directly or after reflection at an angle that is steeper than a light-specific masking angle $\alpha$, and with lamellae that have an approximately V-shaped cross section and run across the vertical middle longitudinal plane of the light source and have reflecting concave side surfaces with a curvature such that all the rays of light reflected in the longitudinal direction of the light source emerge in the longitudinal direction either directly or after reflection at an angle that is steeper than a light-specific masking angle $\beta$, and the top sides of the lamellae are covered by a flat reflecting cover, the improvement comprising:

the lamellae are shaped so as to form two lamellar sections that are symmetrical with respect to the middle vertical longitudinal plane of the light source; and the flat top sides of the lamellae are reflective and run obliquely with respect to the longitudinal plane and with the opposite slopes on opposite sides of the longitudinal plane, starting below the light source, at an angle that corresponds approximately to the masking angle $\alpha$ with tangential but contact-free proximity to the light source, and extending as far as the concave reflectors, so that light rays obliquely leaving the light source will strike the oblique reflecting top surfaces of the lamellae and thus are reflected upwardly to strike the concave reflectors at an angle at least substantially as steep as the masking angle $\alpha$, thereby reducing glare caused by relatively shallow angle reflected light rays.

2. Light fixture according to claim 1, wherein the two inclined lamellar sections are connected by a lamellar section which runs perpendicular to the middle longitudinal plane of the light source, and the length of which is smaller than the diameter of the light source.

3. Light fixture according to claim 1, wherein each lamella has an inclined lower longitudinal edge which is parallel with the top side of the lamella.

* * * * *